US010065296B2

(12) United States Patent
Chuang

(10) Patent No.: US 10,065,296 B2
(45) Date of Patent: Sep. 4, 2018

(54) TORQUE SOCKET HAVING TORQUE ADJUSTING FUNCTION

(71) Applicant: Wei-Chieh Chuang, New Taipei (TW)

(72) Inventor: Wei-Chieh Chuang, New Taipei (TW)

( * ) Notice: Subject to any disclaimer, the term of this patent is extended or adjusted under 35 U.S.C. 154(b) by 181 days.

(21) Appl. No.: 15/355,856

(22) Filed: Nov. 18, 2016

(65) Prior Publication Data

US 2017/0266790 A1 Sep. 21, 2017

(30) Foreign Application Priority Data

Mar. 15, 2016 (TW) ..... 105203526 U

(51) Int. Cl.

| | |
|---|---|
| ***B25B 23/142*** | (2006.01) |
| ***B25B 15/04*** | (2006.01) |
| ***B25B 23/00*** | (2006.01) |
| ***B25B 23/12*** | (2006.01) |
| ***B25B 23/145*** | (2006.01) |
| ***B25B 23/147*** | (2006.01) |
| ***B25B 23/14*** | (2006.01) |

(52) U.S. Cl.

CPC ..... *B25B 23/1427* (2013.01); *B25B 15/04* (2013.01); *B25B 23/0035* (2013.01); *B25B 23/12* (2013.01); *B25B 23/141* (2013.01); *B25B 23/145* (2013.01); *B25B 23/147* (2013.01)

(58) Field of Classification Search

CPC . B25B 23/1427; B25B 23/141; B25B 23/142; B25B 23/145; B25B 23/0035

See application file for complete search history.

(56) References Cited

U.S. PATENT DOCUMENTS

| | | | | |
|---|---|---|---|---|
| 2,772,589 | A * | 12/1956 | Brenholts | B25B 23/141 81/476 |
| 2,872,004 | A * | 2/1959 | Barker | B25B 23/141 192/56.55 |
| 4,346,633 | A * | 8/1982 | Rendl | B25B 23/141 464/43 |
| 7,281,458 | B2 * | 10/2007 | Chuang | B25B 13/06 464/39 |
| 7,967,683 | B2 * | 6/2011 | Chuang | F16D 7/044 464/39 |
| 8,549,963 | B2 | 10/2013 | Chuang | |
| 2001/0025714 | A1 * | 10/2001 | Lieser | B25B 23/141 173/178 |

* cited by examiner

*Primary Examiner* — David B Thomas

(74) *Attorney, Agent, or Firm* — Guice Patents PLLC

(57) ABSTRACT

A torque socket having a torque adjusting function comprises: a shaft rod having two ends axially extended with an insertion tenon and a core shaft having a shaft hole and having the outer circumference thereof radially formed with a first friction surface; an adjustment member disposed in the shaft hole and having the outer circumference thereof formed with a top connection head and a connecting segment; and a shaft cylinder having two axial ends formed with a shaft slot and a sleeve slot, wherein the interior of the shaft slot is radially formed with a second friction surface being in contact with the first friction surface; when rotating the adjustment member, the outer dimension of the core shaft and the contact area of the first friction surface and the second friction surface can be altered for adjusting the torque.

16 Claims, 6 Drawing Sheets

A-A

TORQUE SOCKET HAVING TORQUE ADJUSTING FUNCTION

BACKGROUND OF THE INVENTION

1. Field of the Invention

The present invention relates to a torque socket, especially to a torque socket having a torque adjusting function and having one end thereof sleeved with a manual, pneumatic or electric rotation tool and the other end thereof sleeved with a drive head.

2. Description of Related Art

Conventionally, a screwdriver consists of a grip having a pre-determined length and a drive rod having a drive head, and generally the drive head is formed in a flat or cross shape for being mated with a flat or cross-shaped top recess of a screw, thereby enabling the screw to be fastened or loosened. However, the drive head of the above-mentioned screwdriver has a fixed shape and dimension, other drive heads having different shapes and dimensions cannot be used for replacement.

In view of the disclosed shortages, manufacturers in the related art have developed a manual tool capable of changing drive head, such as a wrench. After the wrench is sleeved with a socket, an insertion slot formed at the bottom end of the socket can be sleeved with a drive head having different shape and dimension, thereby being applicable to various types of screws. However, the socket is only served as a tool for transferring the torque, and the socket itself is not installed with a torque mechanism with a fixed value.

When using a conventional rotation tool such as a screwdriver or a wrench to adjust a lens of an optical device, such as a monitor, because the torque value of the rotation tool is determined by the force applied by a user, so in the adjustment process, the lens is often broken or damaged due to the excessive torque, thereby causing enormous lost.

For preventing the user from using a rotation tool, such as a screwdriver or a wrench, to rotate a connection unit, such as a screw, with a rotation force exceeding the range tolerable by the screw, and causing the screw deformation. As such, a screwdriver having a transmission structure composed of a spring and steel balls for limiting the output torque has been developed, when the above-mentioned screwdriver is in use, if the applied torque is too large, the steel balls would be separated from the spring thereby causing the screwdriver and the drive head to be separated, so an idle rotation status is formed between the screwdriver and the adopted drive head. As such, the screwdriver can merely be controlled to output a preset torque for preventing the connection unit from being damaged.

By using the screwdriver with the transmission performed through the spring and steel balls, the output torque can be controlled at a fixed value, however, a point contact state is formed while the spring and the steel balls being engaged and sliding, such condition may cause the components more likely to be deformed and damaged, thus the limited output torque value is unstable. In addition, because the transmission structure is composed of the spring and the steel balls, the dimension of the screwdriver cannot be designed to be smaller, thus the above-mentioned screwdriver is unable to be applied for fastening a precision instrument.

In view of the shortages of the above-mentioned rotation tool, the applicant of the present invention has developed a torque socket entitled to Taiwan Patent No. M414299 (corresponding to China Patent No. CN201998113U, U.S. Pat. No. 8,549,963B2, Japan Patent No. U3174153 and German Patent Application No. 102012005885.3), take the above-mentioned torque socket for example, in the screwing process of the torque socket, when a preset torque value of the socket is not exceeded, a screw is able to be continuously screwed in, when the screw is rotated and positioned, and the preset torque value is exceeded, a core shaft forms an idle rotation state in a shaft slot, so that the screw can be prevented from being overly tightened and the above-mentioned shortages of the rotation tool can be improved.

However, the above-mentioned torque socket is not provided with a torque adjusting function, the torque may not often reach the preset value because of the tolerance of the manufacturing material, so that the torque output may be insufficient or overly supplied in actual use. Accordingly, how to adjust the torque deviation of the torque socket to the preset torque value before being dispatched from the factory shall be seriously concerned by the skilled people in the art.

SUMMARY OF THE INVENTION

One primary objective of the present invention is to provide a torque socket having a torque adjusting function, thereby enabling the torque deviation of the torque socket to be adjusted to a preset torque value.

For achieving said objective, one technical solution provided by the present invention is to provide a torque socket having a torque adjusting function, which comprises a shaft rod having one end thereof radially formed with a flange, wherein two sides of the flange are respectively and axially extended with an insertion tenon allowing a rotation tool to be connected and a core shaft, the core shaft is axially formed with a shaft hole communicated with the insertion tenon, the outer circumference thereof is respectively and axially formed with at least one cut groove communicated with the shaft hole and radially formed with a first friction surface, the inner circumference of the shaft hole is respectively formed with an abutting surface in a conical shape and a combining segment; and an adjustment member disposed in the shaft hole, wherein the outer circumference thereof is respectively formed with a top connection head in a conical shape and in contact with the abutting surface and a connecting segment threaded with the combining segment; and a shaft cylinder having two axial ends respectively formed with a shaft slot allowing the core shaft to be sleeved and a sleeve slot allowing a drive head to be inserted, wherein the interior of the shaft slot is radially formed with a second friction surface being in contact with the first friction surface; when the adjustment member is rotated, the connecting segment and the top connection head are axially moved respectively along the combining segment and the abutting surface so as to alter the outer dimension of the core shaft, and the contact area defined by the first friction surface and the second friction surface is adjusted, thereby enabling the torque to be adjusted to a preset torque value.

Another objective of the present invention is to provide a torque socket having a torque adjusting function thereby enabling the torque deviation of the torque socket to be adjusted to a preset torque value, capable of generating a sound while a preset torque value being exceed or a connection unit being tightened, and having a non-return function while the connection unit being loosened.

For achieving said objective, one technical solution provided by the present invention is to provide a torque socket having a torque adjusting function, which comprises a shaft rod having one end thereof formed with a flange, wherein two sides of the flange are respectively and axially extended with an insertion tenon allowing a rotation tool to be connected and a core shaft, the core shaft is axially formed with a shaft hole communicated with the insertion tenon, the outer circumference thereof is respectively and axially formed with at least one cut groove communicated with the shaft hole and radially formed with a first friction surface, the inner circumference of the shaft hole is respectively formed with an abutting surface in a conical shape and a combining segment; an adjustment member disposed in the shaft hole, wherein the outer circumference thereof is respectively formed with a top connection head in a conical shape and in contact with the abutting surface and a connecting segment threaded with the combining segment; wherein the core shaft is in sequence sleeved with a resilient member abutted against the flange and a mobile ratchet capable of axially moving on the core shaft and annularly formed with a plurality of unidirectional mobile ratchet teeth; and a shaft cylinder having two axial ends respectively formed with a shaft slot allowing the core shaft to be sleeved and a sleeve slot allowing a drive head to be inserted, the interior of the shaft slot is radially formed with a second friction surface being in contact with the first friction surface; an accommodation slot allowing the mobile ratchet to be accommodated is formed between the shaft slot and the second friction surface, a fixed ratchet axially and annularly formed with a plurality of unidirectional fixed ratchet teeth is fastened in the accommodation slot, and the fixed ratchet teeth are able to be mutually engaged with the mobile ratchet teeth; when the adjustment member is rotated, the connecting segment and the top connection head are axially moved respectively along the combining segment and the abutting surface so as to alter the outer dimension of the core shaft, and the contact area defined by the first friction surface and the second friction surface is adjusted, thereby enabling the torque to be adjusted to a preset torque value; and when the core shaft is rotated in the shaft slot and the preset torque value is exceeded, the core shaft forms an idle rotation state in the shaft slot, thus the mobile ratchet teeth are enabled to be rotated along the fixed ratchet teeth and engaged therewith, thereby allowing the mobile ratchet to be axially and elastically moved for generating a sound.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Referring from FIG. 1 to FIG. 4, the present invention provides a torque socket comprising a shaft rod 1 and a shaft cylinder 2.

Figure 5:
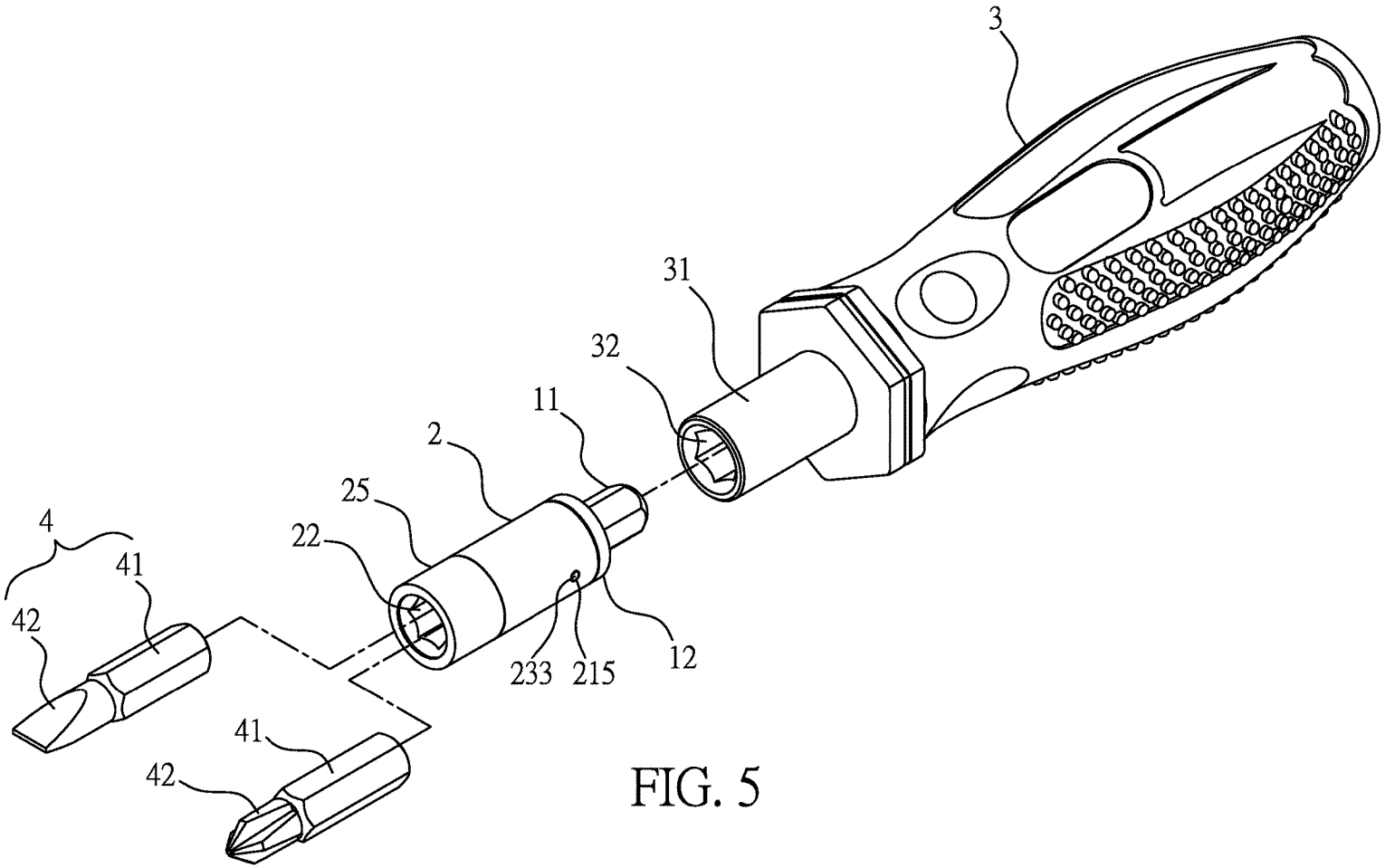
FIG. 5 is a perspective exploded view illustrating the torque socket, the rotation tool and the drive head according to the present invention.

The shaft rod 1 is formed as a rod member, one axial end thereof is formed with a cross section in a non-round shape, such as a hexagonal insertion tenon 11, an inner side of the insertion tenon 11 is radially formed with a flange 12, so that two sides of the flange 12 are adjacently connected to the shaft cylinder 2 and a rotation tool 3, such as a connection rod 31 at the bottom end of a screwdriver grip as shown in FIG. 5. Another side of the flange 12 is extended with a core shaft 13 having a round cross section, and the outer circumference of the core shaft 13 is axially formed with at least one cut groove 131 for providing a proper elasticity to the core shaft 13. Moreover, the outer circumference of the core shaft 13 is radially formed with a first friction surface 132 in a recessed region and a convex buckle part 133, the core shaft 13 is axially formed with a shaft hole 134 communicated with the insertion tenon 11, and the shaft hole 134 is communicated with the at least one cut groove 131.

Moreover, the periphery of at least one of the cut grooves 131 of the core shaft 13 is formed with an oil storage zone 135 such as being formed by a milling cutter for the purpose of storing lubrication oil, thereby increasing the smooth effect while the core shaft 13 is rotating in the shaft cylinder 2.

Furthermore, for providing the first friction surface 132 of the core shaft 13 a radially expanding or retracting function, the inner circumference defined at one end (the inner side) of the shaft hole 134 is formed with an abutting surface 134*a* in a conical shape, and the middle portion thereof is formed with a combining segment 134*b*, such as an inner thread, and another end (the outer side) of the shaft hole 134 is served to allow a tool, such as a hexagonal wrench, to be inserted.

Figure 1:
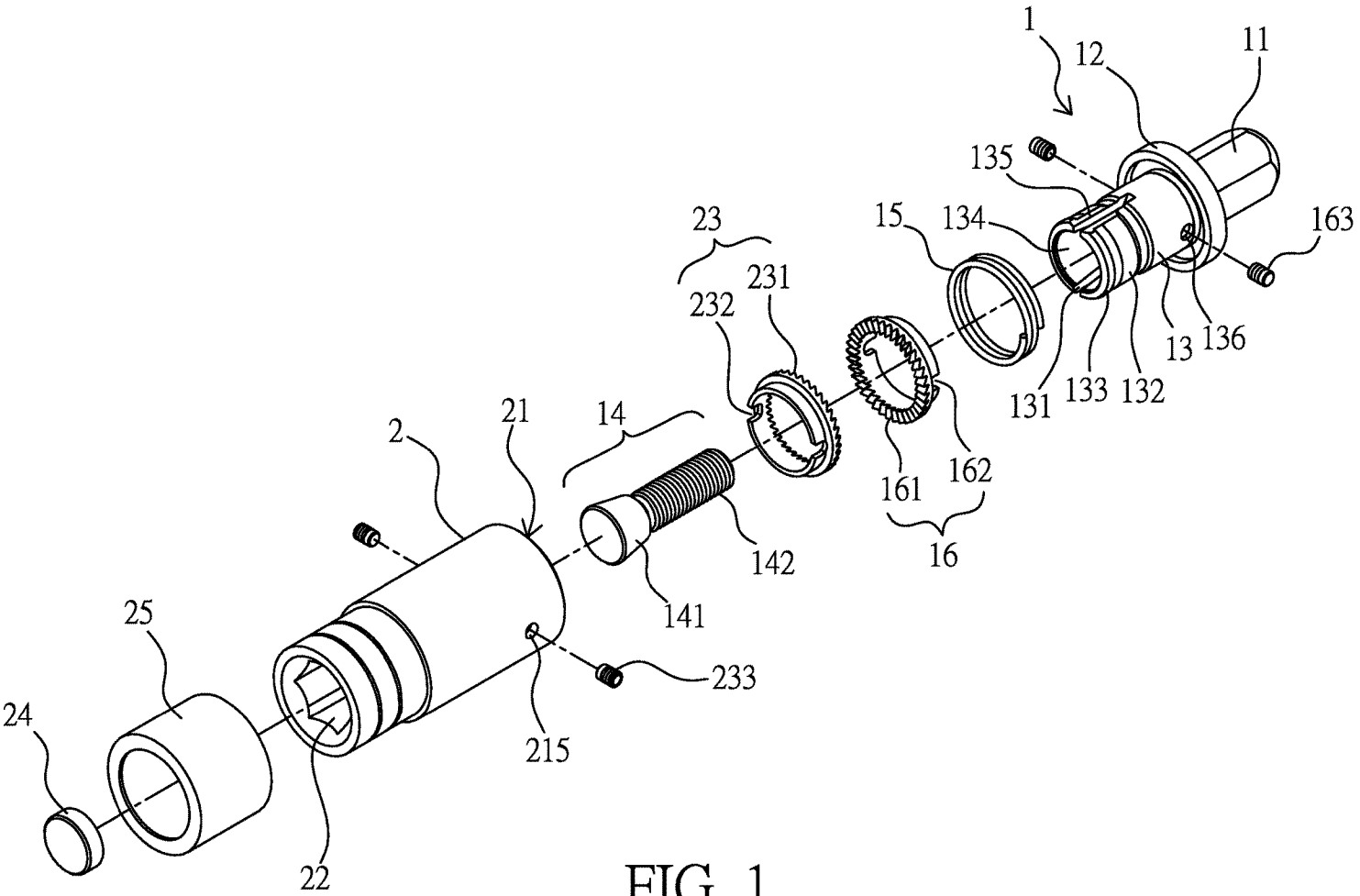
FIG. 1 is a perspective exploded view illustrating the torque socket according to the present invention.
Figure 2:
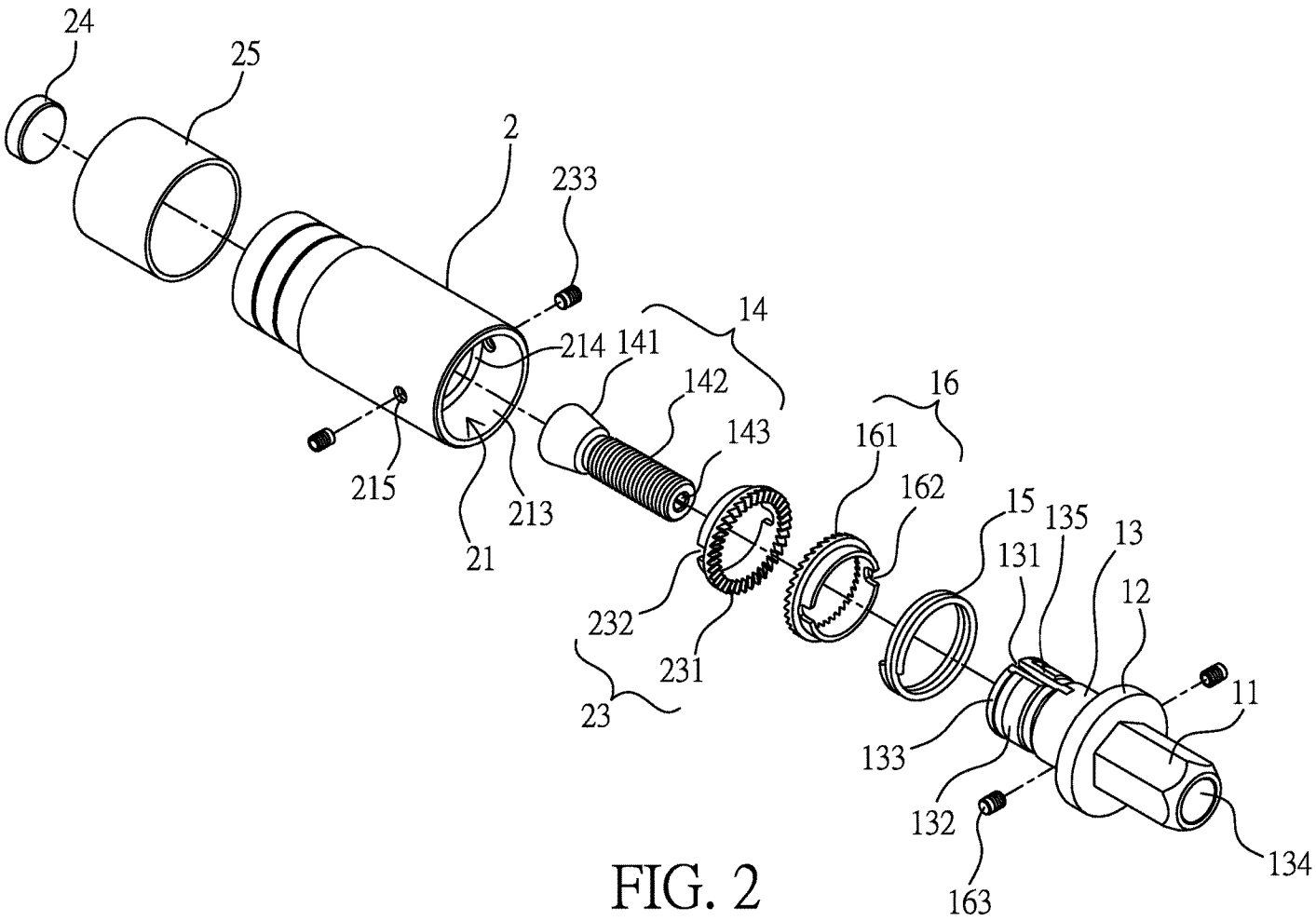
FIG. 2 is another perspective exploded view illustrating the torque socket according to the present invention.

The interior of the shaft hole 134 is provided with an adjustment member 14, and two ends defined on the outer circumference of the adjustment member 14 are respectively formed with a top connection head 141 in a conical shape and a connecting segment 142, such as an outer thread. One end surface of the connecting segment 142 is axially formed with a rotation hole 143 (as shown in FIG. 2) having a non-round cross section, such as a hexagonal cross section. When being assembled, a user inserts the adjustment member 14 into the shaft hole 134 and rotates the top connection head 141 for enabling the connecting segment 142 to be threaded with the combining segment 134*b*, so that the top connection head 141 is accommodated in the abutting surface 134*a*, and the conical surfaces of the above two are in a contacting status.

Moreover, at the inner side of the flange 12, the core shaft 13 is in sequence sleeved with a resilient member 15, such as a spring or a resilient disc, and a mobile ratchet 16 capable of axially moving on the core shaft 13, the inner side and the outer side of the mobile ratchet 16 are respectively and axially and annularly formed with a plurality of unidirectional mobile ratchet teeth 161 and radially formed with at least one position limiting slot 162, and a position limiting pin 163 is provided for passing the position limiting slot 162 and being inserted in a first pin hole 136 radially preformed on the core shaft 13, so that the mobile ratchet 16 is enabled to axially and elastically move on the core shaft 13.

The shaft cylinder 2 is formed as a hollow columnar body, two axial ends thereof are respectively formed with a shaft slot 21 having a round cross section and a sleeve slot 22 having a non-round cross section, such as a hexagonal cross section. The dimension of the shaft slot 21 is slightly smaller than that of the core shaft 13, thereby allowing the above two to be connected and mounted with a conventional tightening means, and a rotation shaft structure having stopping and positioning effects is formed. Wherein, the shaft slot 21 is formed as a round stepped hole, the inner circumference thereof is formed with a second friction surface 211 and a concave buckle part 212 respectively corresponding to the first friction surface 132 and the convex buckle part 133 the of the core shaft 13, the convex buckle part 133 is able to be buckled in the concave buckle part 212, thereby preventing the shaft rod 1 and the shaft cylinder 2 from being axially released. Moreover, the second friction surface 211 is able to tighten the first friction surface 132, thereby forming a torque between the above two.

An accommodation slot 213 allowing the mobile ratchet 16 to be accommodated is formed between the outer opened end of the shaft slot 21 and the second friction surface 211, a fixed ratchet 23 is fastened in the accommodation slot 213, and the inner side of the fixed ratchet 23 is abutted against a stop flange 214 radially formed in the accommodation slot 213, the inner side and the outer side of the fixed ratchet 23 are respectively and axially and annularly formed with a plurality of unidirectional fixed ratchet teeth 231 and radially formed with at least one positioning slot 232, a positioning pin 233 is provided for passing a second pin hole 215 radially preformed on the outer circumference of the shaft slot 21 and being inserted in the positioning slot 232. As such, the fixed ratchet 23 is enabled to be fastened in the accommodation slot 213 and prevented from rotating.

The sleeve slot 22 is used for allowing a sleeve rod 41 of a drive head 4 shown in FIG. 5 to be sleeved and positioned therein, in actual practice, the free end of the drive head 4 can be a tenon head 42 having a flat, cross or other geometric shape, the disclosed arrangement is well known by skilled people in the art so no further illustration is provided. For providing a magnetic force to the drive head 4, a magnet 24 is disposed in the sleeve slot 22, thereby providing the magnetic force to the sleeved drive head 4 for attracting a connection unit made of a magnetic conductive material, such as a screw.

Moreover, the outer circumference of the shaft cylinder 2 is disposed, such as adhered, with an indication ring 25 for indicating a torque value, the indicating ring 25 is served to indicate the torque value of the torque socket, such as 0.6 Nm (Newton-meter), 0.9 Nm, 1.2 Nm, 1.4 Nm, 2.0 Nm, 3.0 Nm, 5.0 Nm or 5.5 Nm, so that the torque socket with a different torque value is able to be provided with the indication ring 25 having a different color for the purpose of indication, for example the torque socket with 0.6 Nm is provided with the red indication ring 25, and the torque socket with 0.9 Nm is provided with the yellow indication ring 25.

Figure 3:
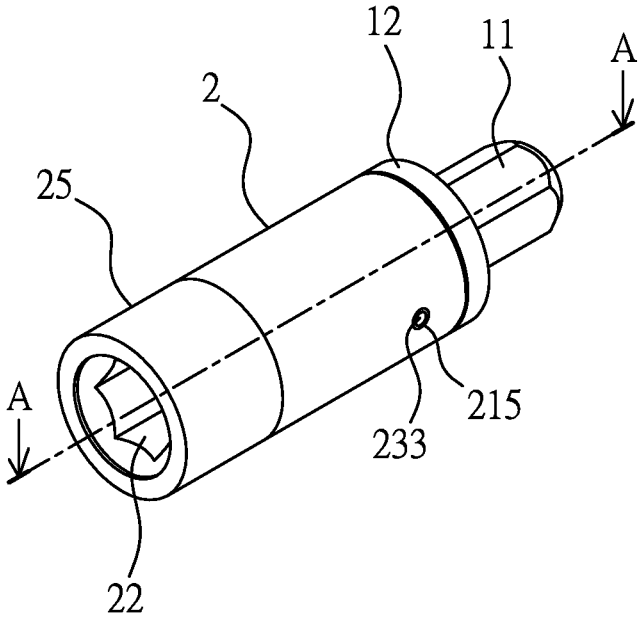
FIG. 3 is a perspective view illustrating the assembly of the torque socket according to the present invention.
Figure 4:
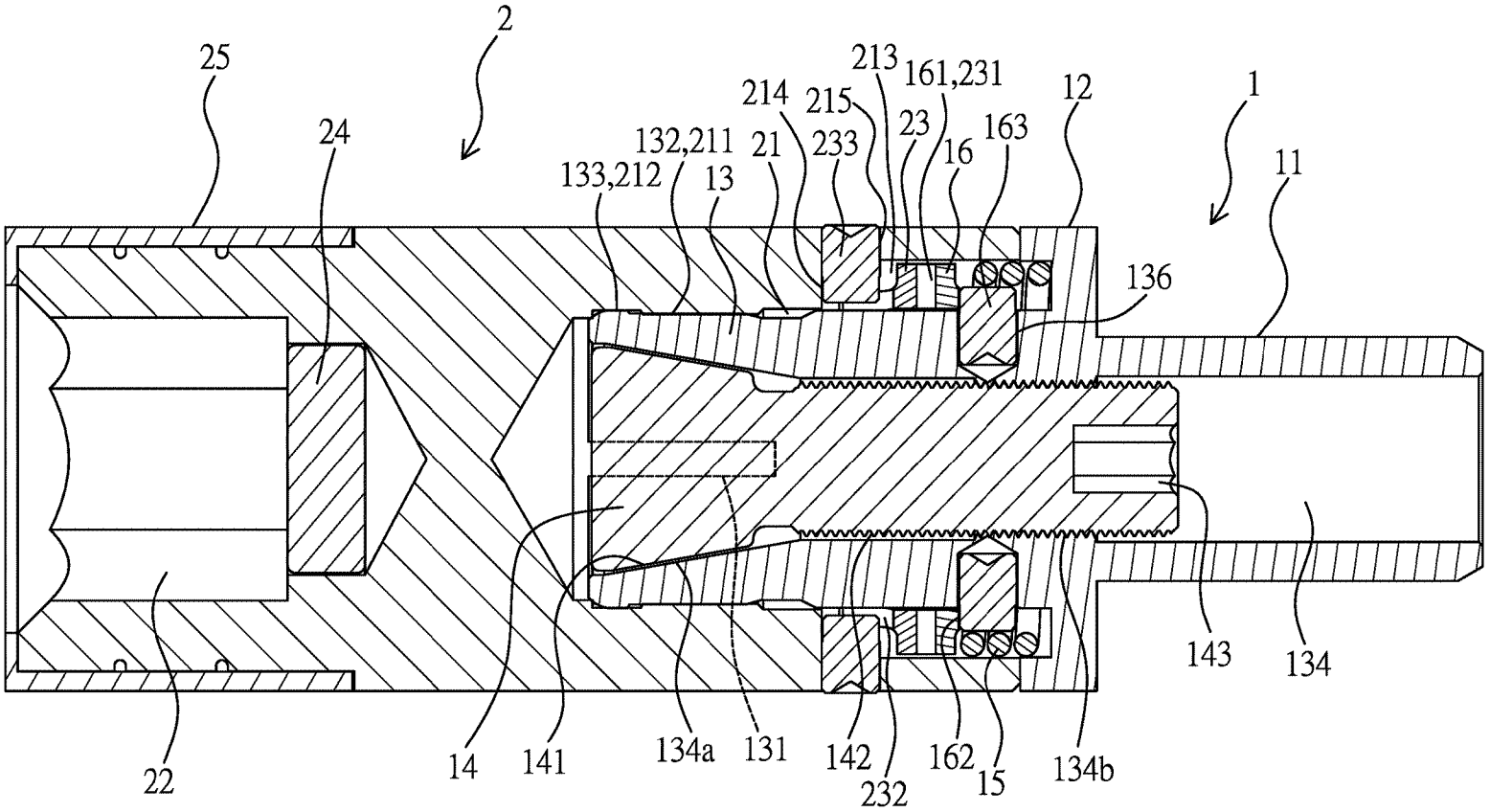
FIG. 4 is a cross sectional view of FIG. 3 taken along an A-A line.

As shown from FIG. 1 to FIG. 4, when being assembled, the core shaft 13 of the shaft rod 1 is inserted in the shaft slot 21 of the shaft cylinder 2, and the convex buckle part 133 of the core shaft 13 is buckled in the concave buckle part 212 of the shaft slot 21 so as to prevent the shaft rod 1 and the shaft cylinder 2 from being axially released. At this moment, the energy released by the resilient member 15 is applied to the mobile ratchet 16 sleeved with the core shaft 13, so the unidirectional mobile ratchet teeth 161 of the mobile ratchet 16 and the fixed ratchet teeth 231 of the fixed ratchet 23 are able to be mutually engaged, thereby forming the torque socket as shown in FIG. 3 and FIG. 4.

If a torque deviation adjustment is desired to be processed, an operator of the manufacturer can utilize a tool, such as a hexagonal wrench, to pass the shaft hole 134 and insert into the rotation hole 143 for the purpose of rotation, so that the adjustment member 14 is able to be axially moved in the shaft hole 134, and the top connection head 144 is able to be moved along the abutting surface 134*a*, thereby altering the outer dimension of the core shaft 13, such as radially expanding or retracting, and the contact area defined between the first friction surface 132 and the second friction surface 211 can be adjusted so as to adjust the torque to a preset torque value.

Figure 6:
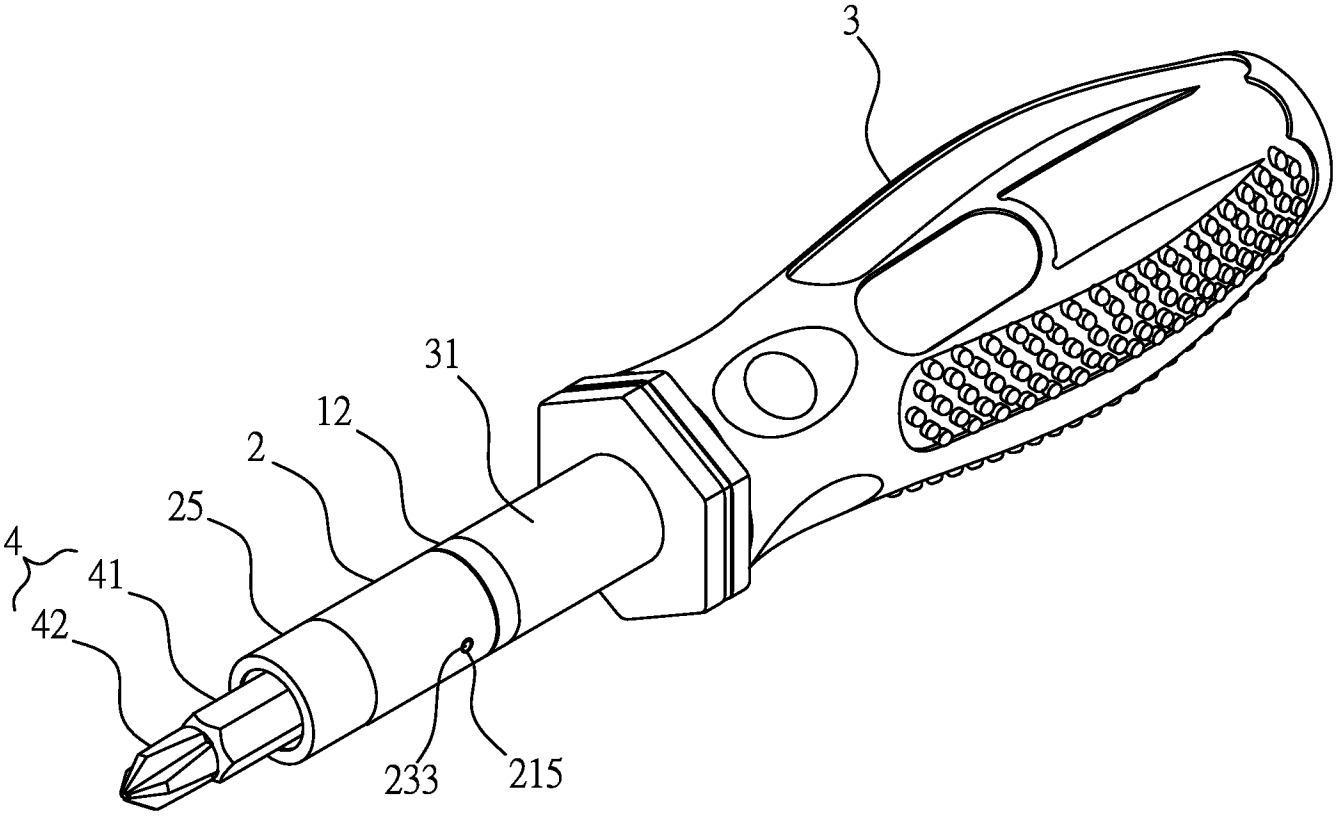
FIG. 6 is a perspective view illustrating the assembly of the torque socket, the rotation tool and the drive head according to the present invention.

As shown in FIG. 5, the insertion tenon 11 of the shaft rod 1 is inserted in the rotation tool 3, such as an insertion slot 32 of the connection rod 31 at the bottom end of the screwdriver grip, and the sleeve slot 22 of the shaft cylinder 2 is sleeved with the selected drive head 4, thereby forming a combining status as shown in FIG. 6. Wherein, the rotation tool 3 is not limited to a grip of a manual screwdriver. What shall be addressed in that the torque socket of the present invention can also be applied in a pneumatic or electric rotation tool and the anticipated tightening or loosening effects can also be achieved.

In actual practice, the tenon head 42 of the drive head 4 is firstly aimed at a connection unit such as the top recess of a screw, installed at the periphery of a lens of the precision instrument such as a monitor, then the rotation tool 3 is rotated by a hand for enabling the shaft rod 1 to drive the shaft cylinder 2 and the drive head 4 to synchronously rotate so as to process a fastening operation; during the screwing process, the screw is able to be continuously screwed in when the preset torque value of the preset socket is not exceeded, when the screw is rotated and positioned (tightened and fastened) or the preset torque value is exceeded, the core shaft 13 forms an idle rotation state in the shaft slot 21, so that the mobile ratchet teeth 161 of the mobile ratchet 16 sleeved with the core shaft 13 are rotated along the fixed ratchet teeth 231 of the fixed ratchet 23 and engaged therewith, thereby allowing the mobile ratchet 16 to be axially and elastically moved for generating a sound to remind the user that the screw has already been in a tightened status or the preset torque value has been reached; accordingly, the lens is protected from being overly pressed or even broken due to the screw being overly tightened.

Based on what has been disclosed above, advantages achieved by the present invention are as followings: through the adjustment member being axially moved and adjusted in the core shaft, the outer dimension of the core shaft can be altered, such as being radially expanded or retracted, and the contact area defined by the core shaft and the shaft slot can be adjusted so as to adjust the torque to the preset torque value; moreover, with the non-return ratchet structure oppositely disposed in the core shaft and the shaft slot, a situation of improper screwing can be avoided, and the core shaft is able to form the idle rotation state in the shaft slot when the torque exceeds the range tolerable by the connection unit, and the non-return ratchet structure can generate a sound for the purpose of informing, so that unnecessary loss can be prevented; furthermore, the mobile ratchet and the fixed ratchet of the non-return ratchet structure are in a unidirectional engaging status for providing a non-return function, so that a loosening operation of the connection unit can be more easily performed; accordingly, the present invention is novel and more practical comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A torque socket having torque adjusting function, comprising:

a shaft rod, having one end thereof radially formed with a flange, wherein two sides of said flange are respectively and axially extended with an insertion tenon allowing a rotation tool to be connected and a core shaft, said core shaft is axially formed with a shaft hole communicated with said insertion tenon, the outer circumference thereof is respectively and axially formed with at least one cut groove communicated with said shaft hole and radially formed with a first friction surface, the inner circumference of said shaft hole is respectively formed with an abutting surface in a conical shape and a combining segment; and an adjustment member disposed in said shaft hole, wherein the outer circumference thereof is respectively formed with a top connection head in a conical shape and in contact with said abutting surface and a connecting segment threaded with said combining segment; and a shaft cylinder, having two axial ends respectively formed with a shaft slot allowing said core shaft to be sleeved and a sleeve slot allowing a drive head to be inserted, wherein the interior of said shaft slot is radially formed with a second friction surface being in contact with said first friction surface;

when said adjustment member is rotated, said connecting segment and said top connection head are axially moved respectively along said combining segment and said abutting surface so as to alter the outer dimension of said core shaft, and the contact area defined by said first friction surface and said second friction surface is adjusted, thereby enabling the torque to be adjusted to a preset torque value.

2. The torque socket having torque adjusting function as claimed in claim 1, wherein one end surface of said connecting segment is axially formed with a rotation hole having a non-round cross section and allowing a tool to be inserted for the purpose of rotation.

3. The torque socket having torque adjusting function as claimed in claim 1, wherein the cross section of said insertion tenon and that of said sleeve slot are formed in a non-round shape, and the cross section of said core shaft and that of said shaft slot are formed in a round shape.

4. The torque socket having torque adjusting function as claimed in claim 1, wherein the outer circumference of said core shaft is radially formed with a convex buckle part, and the inner circumference of said shaft slot is formed with a concave buckle part corresponding to said convex buckle part and allowing said convex buckle part to be buckled with.

5. The torque socket having torque adjusting function as claimed in claim 1, wherein the interior of said sleeve slot is disposed with a magnet.

6. The torque socket having torque adjusting function as claimed in claim 1, wherein said core shaft is formed with an oil storage zone at the periphery of said at least one cut groove.

7. The torque socket having torque adjusting function as claimed in claim 1, wherein the outer circumference of said shaft cylinder is disposed with an indication ring for indicating a torque value.

8. A torque socket having torque adjusting function, comprising:

a shaft rod, having one end thereof formed with a flange, wherein two sides of said flange are respectively and axially extended with an insertion tenon allowing a rotation tool to be connected and a core shaft, said core shaft is axially formed with a shaft hole communicated with said insertion tenon, the outer circumference thereof is respectively and axially formed with at least one cut groove communicated with said shaft hole and radially formed with a first friction surface, the inner circumference of said shaft hole is respectively formed with an abutting surface in a conical shape and a combining segment; an adjustment member disposed in said shaft hole, wherein the outer circumference thereof is respectively formed with a top connection head in a conical shape and in contact with said abutting surface and a connecting segment threaded with said combining segment; wherein said core shaft is in sequence sleeved with a resilient member abutted against said flange and a mobile ratchet capable of axially moving on said core shaft and annularly formed with a plurality of unidirectional mobile ratchet teeth; and a shaft cylinder, having two axial ends respectively formed with a shaft slot allowing said core shaft to be sleeved and a sleeve slot allowing a drive head to be inserted, the interior of said shaft slot is radially formed with a second friction surface being in contact with said first friction surface; an accommodation slot allowing said mobile ratchet to be accommodated is formed between said shaft slot and said second friction surface, a fixed ratchet axially and annularly formed with a plurality of unidirectional fixed ratchet teeth is fastened in said accommodation slot, and said fixed ratchet teeth are able to be mutually engaged with said mobile ratchet teeth;

when said adjustment member is rotated, said connecting segment and said top connection head are axially moved respectively along said combining segment and said abutting surface so as to alter the outer dimension of said core shaft, and the contact area defined by said first friction surface and said second friction surface is adjusted, thereby enabling the torque to be adjusted to a preset torque value; and when said core shaft is rotated in said shaft slot and said preset torque value is exceeded, said core shaft forms an idle rotation state in said shaft slot, thus said mobile ratchet teeth are enabled to be rotated along said fixed ratchet teeth and engaged therewith, thereby allowing said mobile ratchet to be axially and elastically moved for generating a sound.

9. The torque socket having torque adjusting function as claimed in claim 8, wherein one end surface of said connecting segment is axially formed with a rotation hole having a non-round cross section and allowing a tool to be inserted for the purpose of rotation.

10. The torque socket having torque adjusting function as claimed in claim 8, wherein the cross section of said insertion tenon and that of said sleeve slot are formed in a non-round shape, and the cross section of said core shaft and that of said shaft slot are formed in a round shape.

11. The torque socket having torque adjusting function as claimed in claim 8, wherein the outer circumference of said core shaft is radially formed with a convex buckle part, and the inner circumference of said shaft slot is formed with a concave buckle part corresponding to said convex buckle part and allowing said convex buckle part to be buckled with.

12. The torque socket having torque adjusting function as claimed in claim 8, wherein the interior of said sleeve slot is disposed with a magnet.

13. The torque socket having torque adjusting function as claimed in claim 8, wherein said core shaft is formed with an oil storage zone at the periphery of said at least one cut groove.

14. The torque socket having torque adjusting function as claimed in claim 8, wherein the outer circumference of said shaft cylinder is disposed with an indication ring for indicating a torque value.

15. The torque socket having torque adjusting function as claimed in claim 8, wherein said mobile ratchet is radially formed with at least one position limiting slot, and a position limiting pin is provided for passing said position limiting slot and being inserted in a first pin hole radially formed on said core shaft, so that said mobile ratchet is enabled to axially and elastically move on said core shaft; and said fixed ratchet is radially formed with at least one positioning slot, a positioning pin is provided for passing a second pin hole radially formed on said shaft slot and being inserted in said positioning slot, thereby preventing said fixed ratchet from rotating in said accommodation slot.

16. The torque socket having torque adjusting function as claimed in claim 8, wherein said resilient member is a spring or a resilient disc.

* * * * *